US008009109B2

(12) United States Patent
So et al.

(10) Patent No.: US 8,009,109 B2
(45) Date of Patent: Aug. 30, 2011

(54) INTERNAL ANTENNA HAVING SURFACE-MOUNTED RECEPTACLE

(75) Inventors: Soon-Jong So, Gyeonggi-do (KR); Sang-Hyuk Mun, Incheon (KR); Suk-Hwan Seo, Gyeonggi-do (KR); Ji-Soo Han, Gyeonggi-do (KR)

(73) Assignee: Ace Antenna Corp., Incheon-Shi (KR)

( * ) Notice: Subject to any disclaimer, the term of this patent is extended or adjusted under 35 U.S.C. 154(b) by 418 days.

(21) Appl. No.: 12/240,984

(22) Filed: Sep. 29, 2008

(65) Prior Publication Data

US 2009/0085816 A1 Apr. 2, 2009

(30) Foreign Application Priority Data

Sep. 28, 2007 (KR) ..... 10-2007-0097710

(51) Int. Cl.
*H01Q 1/24* (2006.01)

(52) U.S. Cl. ..... 343/702; 343/906

(58) Field of Classification Search ..... 343/700 MS, 343/702, 906

See application file for complete search history.

(56) References Cited

U.S. PATENT DOCUMENTS

| | | | | |
|---|---|---|---|---|
| 6,295,197 | B1 * | 9/2001 | Watts et al. | 361/679.4 |
| 7,471,253 | B2 * | 12/2008 | Kinney et al. | 343/702 |
| 7,626,551 | B2 * | 12/2009 | Chien et al. | 343/700 MS |
| 2002/0098456 | A1 * | 7/2002 | Freeman et al. | 431/291 |
| 2007/0146213 | A1 * | 6/2007 | Soekawa et al. | 343/702 |

* cited by examiner

*Primary Examiner* — Hoanganh Le
(74) *Attorney, Agent, or Firm* — LRK Patent Law Firm

(57) ABSTRACT

Disclosed herein is an internal antenna having a surface-mounted receptacle. The internal antenna includes a printed circuit board, a radiator, and a frame. The printed circuit board is configured such that a receptacle is surface-mounted thereon. The radiator is connected to the printed circuit board. The frame is configured such that the printed circuit board and the radiator are mounted thereto.

9 Claims, 9 Drawing Sheets

[FIG.2A]
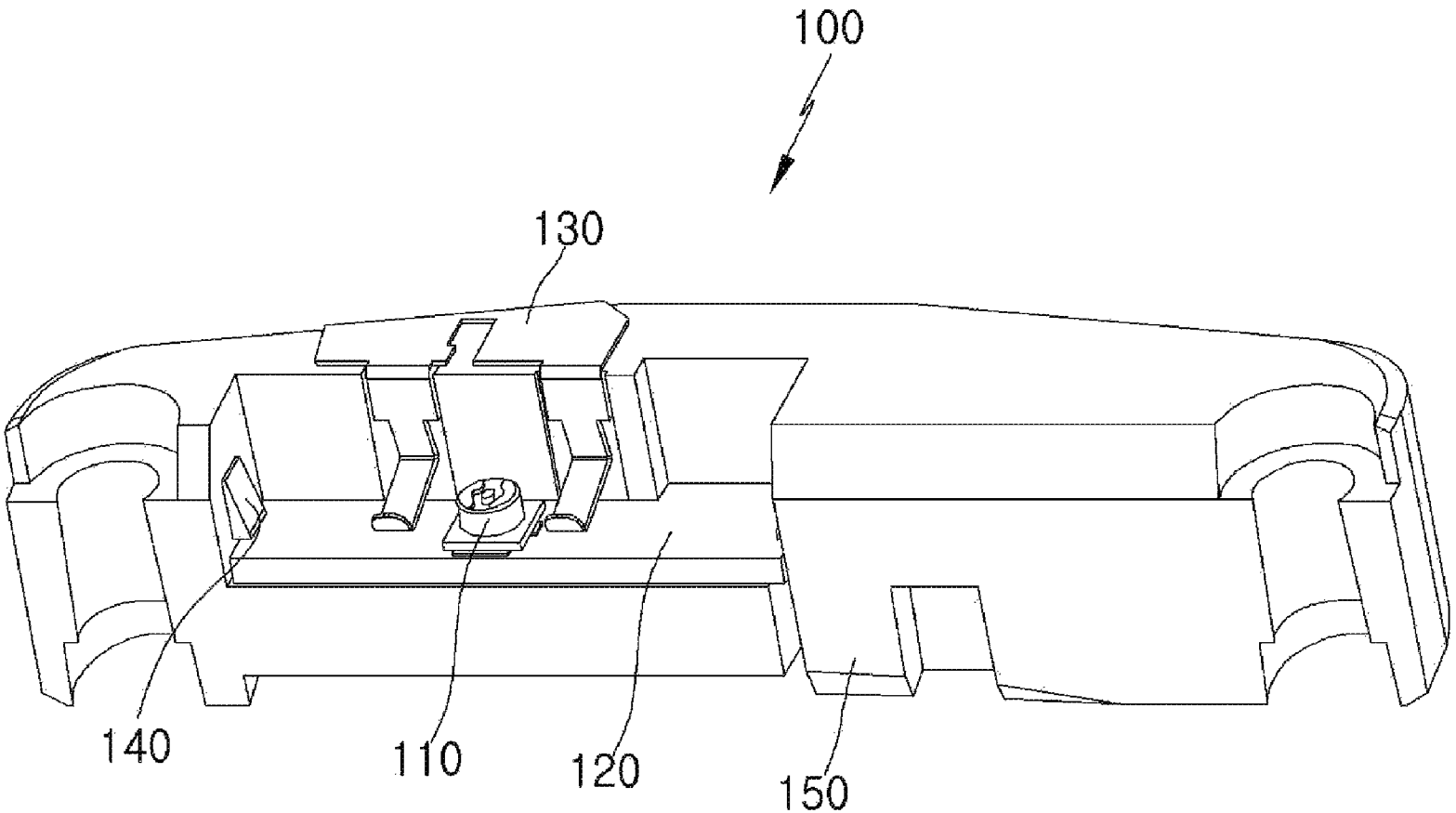

[FIG.2B]
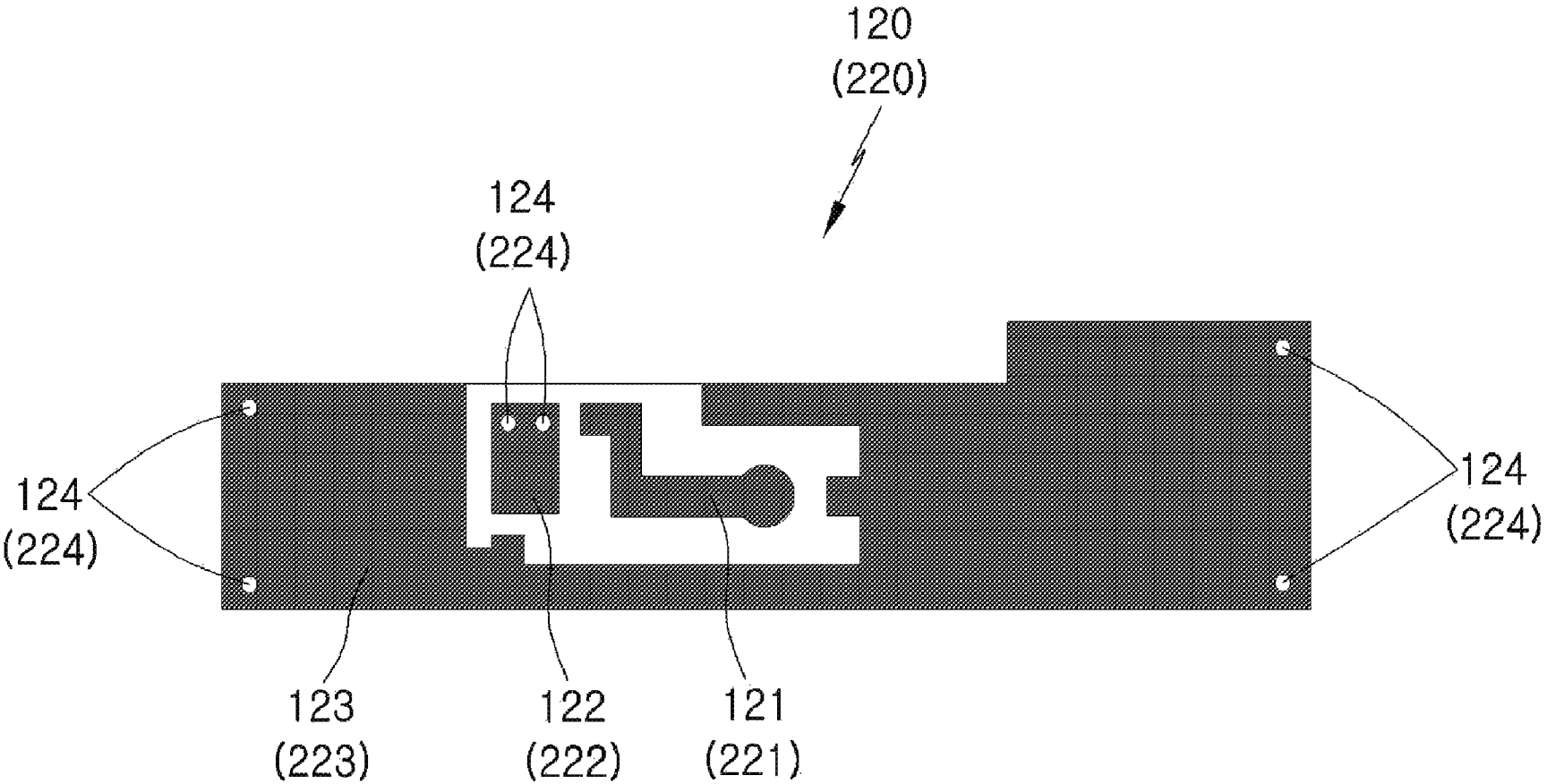

[FIG.2C]
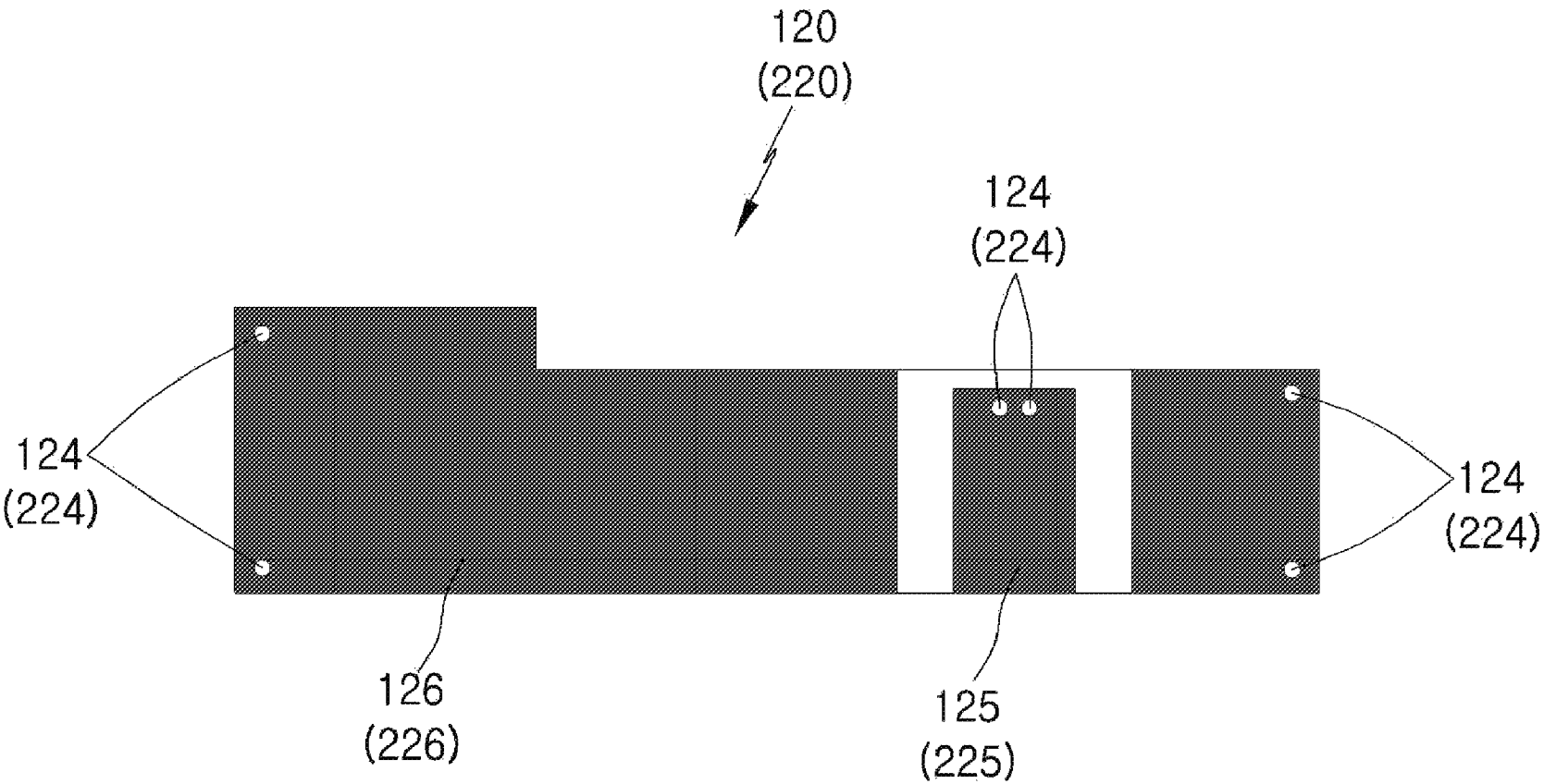

[FIG.2D]
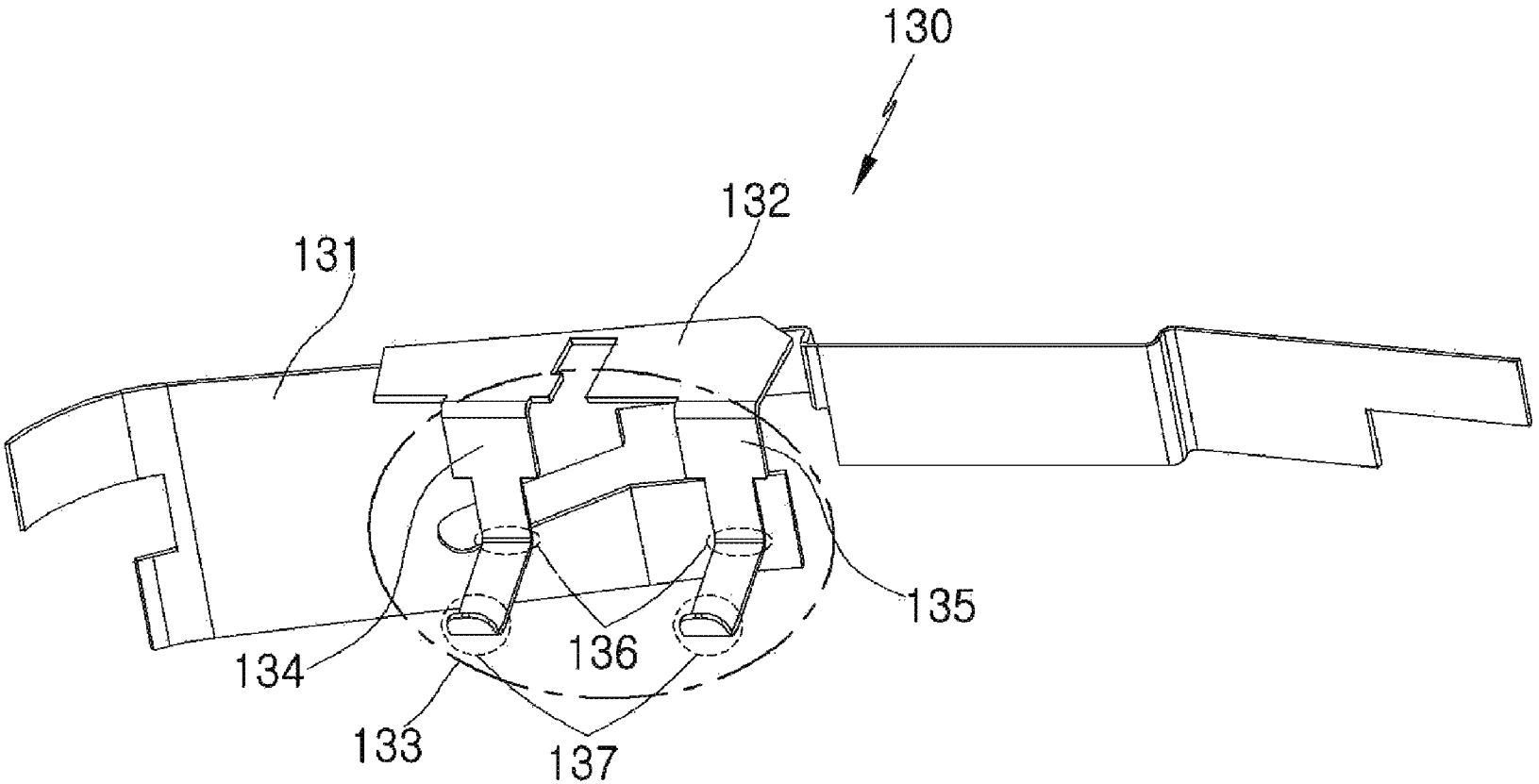

[FIG.2E]
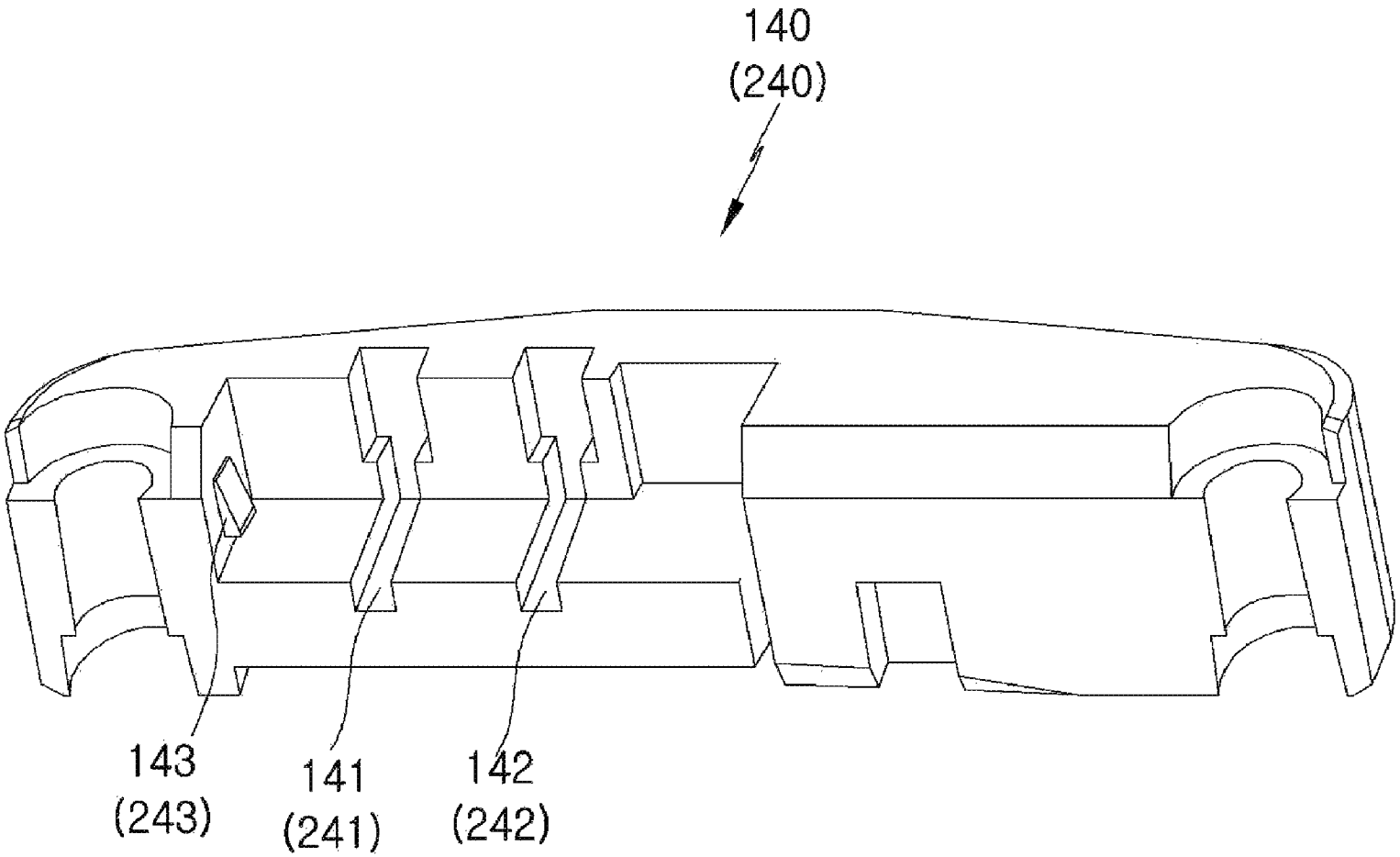

[FIG.3A]
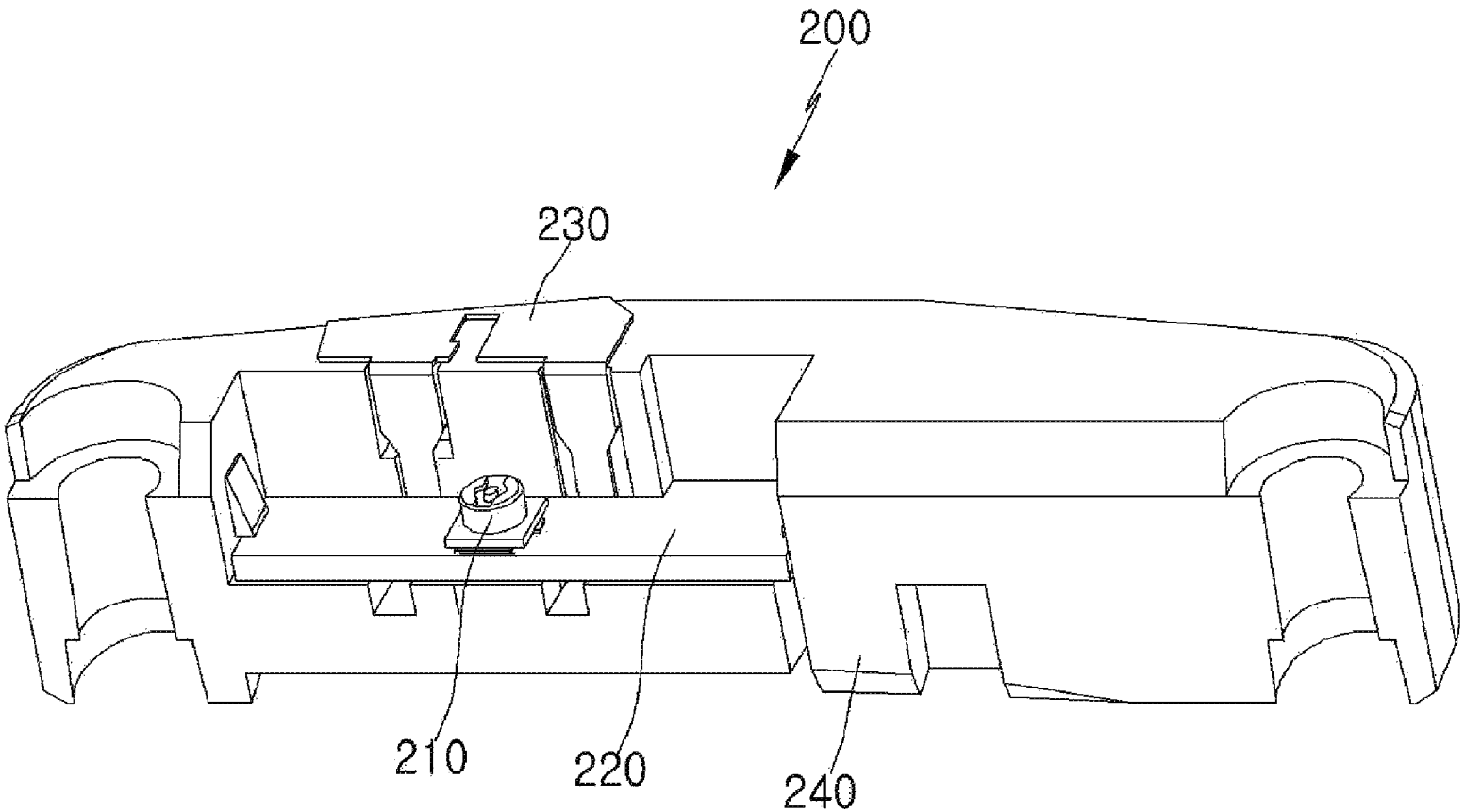

[FIG.3B]
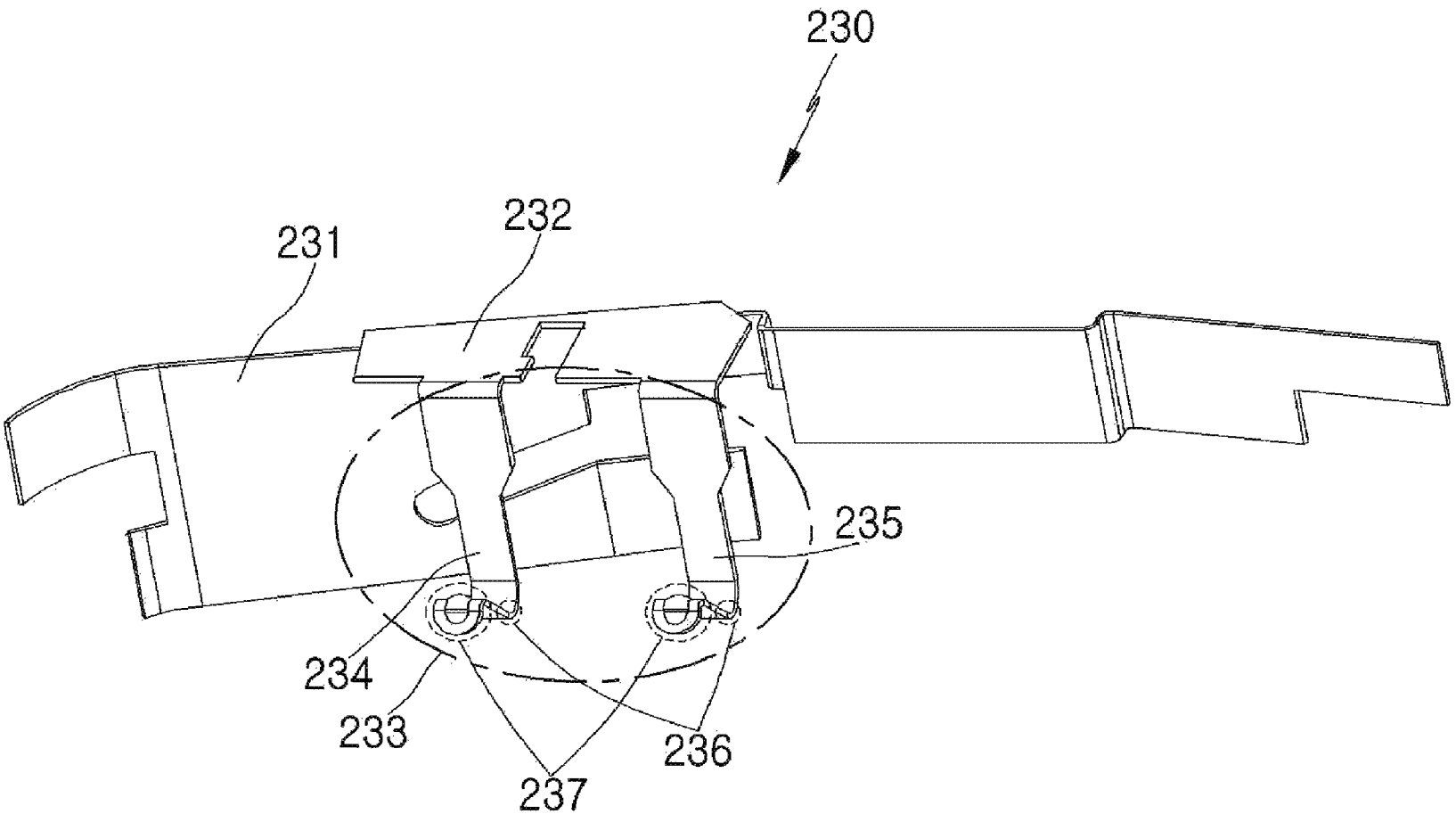

INTERNAL ANTENNA HAVING SURFACE-MOUNTED RECEPTACLE

BACKGROUND OF THE INVENTION

1. Field of the Invention

The present invention relates generally to mobile terminal internal antennas, and more particularly, to an internal antenna having a surface-mounted receptacle, which is configured such that the receptacle is surface-mounted on a printed circuit board. A feeding pattern and a ground pattern are formed on the printed circuit board, which is provided with a radiator having a terminal part that is electrically connected to the feeding pattern and the ground pattern, and which is also connected with a cable via the receptacle mounted in the internal antenna, so as to be connected with the main board of a mobile terminal.

2. Description of the Related Art

Current mobile terminal internal antennas which are configured so as to be separated from the main board of the mobile terminal are connected to the main board using a cable.

In this case, in order to make a connection between the internal antenna and the cable, a receptacle is mounted on the internal antenna.

FIG. 1A is a view showing an example of a conventional internal antenna having a surface-mounted receptacle, and FIG. 1B is a view showing another example of a conventional internal antenna having a surface-mounted receptacle.

As shown in FIG. 1A, the internal antenna includes a surface-mounted receptacle 11, a printed circuit board 12, which is configured such that a feeding pattern and a ground pattern are formed on the upper surface thereon, a radiator 13, which is connected to the feeding pattern and the ground pattern, and a frame 14, which is used to fasten the printed circuit board 12 and the radiator 13.

Alternatively, as shown in FIG. 1B, the internal antenna includes a surface-mounted receptacle 21, a printed circuit board 22, which is provided with a surface-mounted pin 23, a radiator 24, which has a pin hole so it may be fastened to the printed circuit board 22 by the pin 23, and a frame 25, which is used to fasten the printed circuit board 22 and the radiator 24.

To connect the radiator 24 to the printed circuit board 22, the pin 23 is inserted through the pin hole and subsequently compressed and deformed.

However, in the conventional internal antenna of FIG. 1A, a malfunction may occur due to cold solder joints between the printed circuit board 12 and the radiator 13. Furthermore, in the conventional internal antenna of FIG. 1B, a connection method using the pin 23 is used, so that an electrical connection malfunction may occur if the pin 23 becomes damaged in the process of compressing the pin 23 or if the pin oscillates, which decreases phone call quality.

SUMMARY OF THE INVENTION

Accordingly, the present invention has been made keeping in mind the above problems occurring in the prior art, and the present invention provides an internal antenna having a surface-mounted receptacle and a radiator, which is configured such that a terminal part extends from a radiation part, is electrically connected to a printed circuit board on which a feeding pattern and a ground pattern are formed. Thus, not only are manufacturing costs reduced thanks to the reduction in the number of components, but also the manufacturing process is simplified. In addition, the electrical connection between the printed circuit board and the radiator is stably maintained.

The present invention provides an internal antenna having a surface-mounted receptacle, including: a printed circuit board configured such that a receptacle is surface-mounted thereon; a radiator connected to the printed circuit board; and a frame configured such that the printed circuit board and the radiator are mounted thereto.

BRIEF DESCRIPTION OF THE DRAWINGS

The above and other objects, features and advantages of the present invention will be more clearly understood from the following detailed description taken in conjunction with the accompanying drawings, in which:

FIG. 2A is a view showing the construction of an internal antenna having a surface-mounted receptacle according to an embodiment of the present invention;

FIGS. 2B and 2C are top and bottom views respectively of the printed circuit board of FIG. 2A;

FIG. 2D is a view showing the construction of the radiator of FIG. 2A;

FIG. 2E is a view showing the construction of the frame of FIG. 2A;

FIG. 3A is a view showing the construction of an internal antenna having a surface-mounted receptacle according to another embodiment of the present invention; and FIG. 3B is a view showing the construction of the radiator of FIG. 3A.

DESCRIPTION OF THE PREFERRED EMBODIMENTS

Figure 1A:
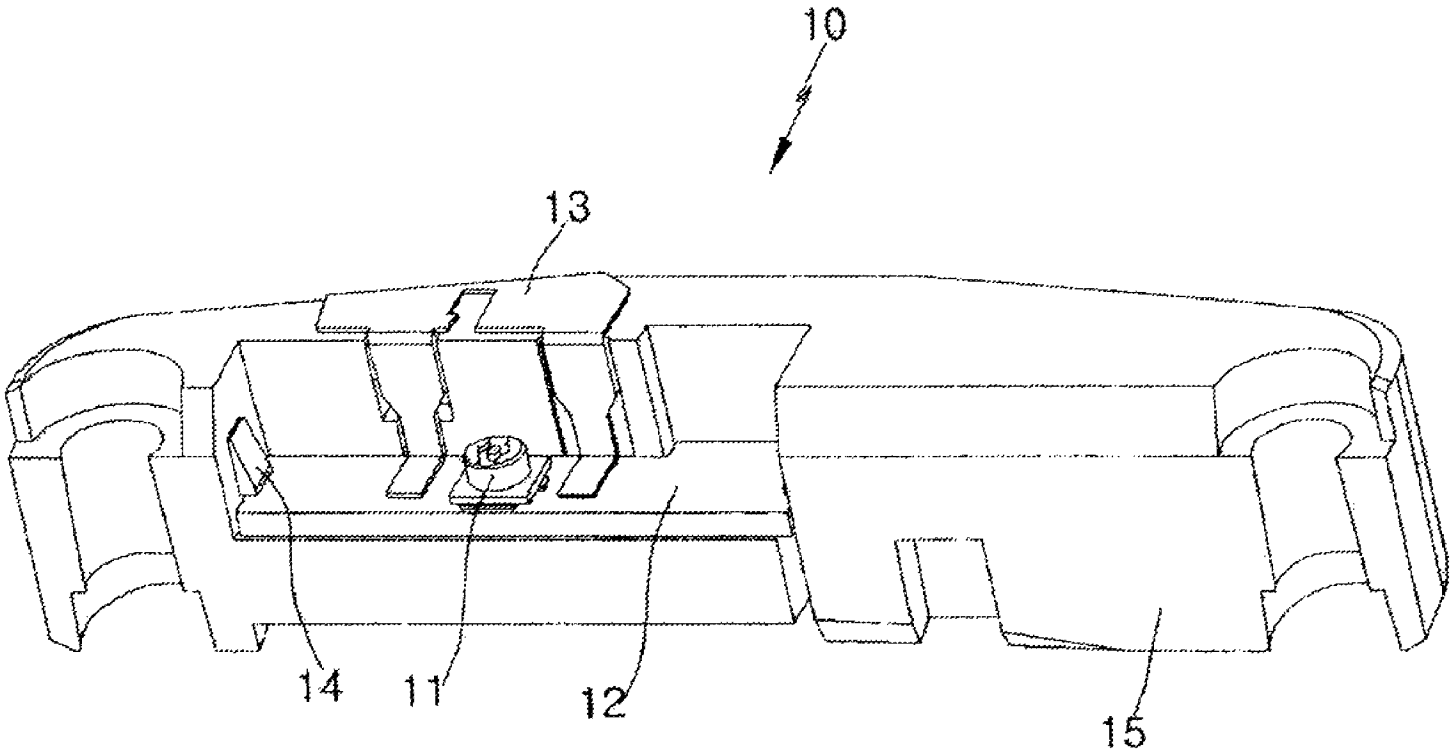
FIG.1A PRIOR ART
FIG. 1A is a view showing an example of a conventional internal antenna having a surface-mounted receptacle.
Figure 1B:
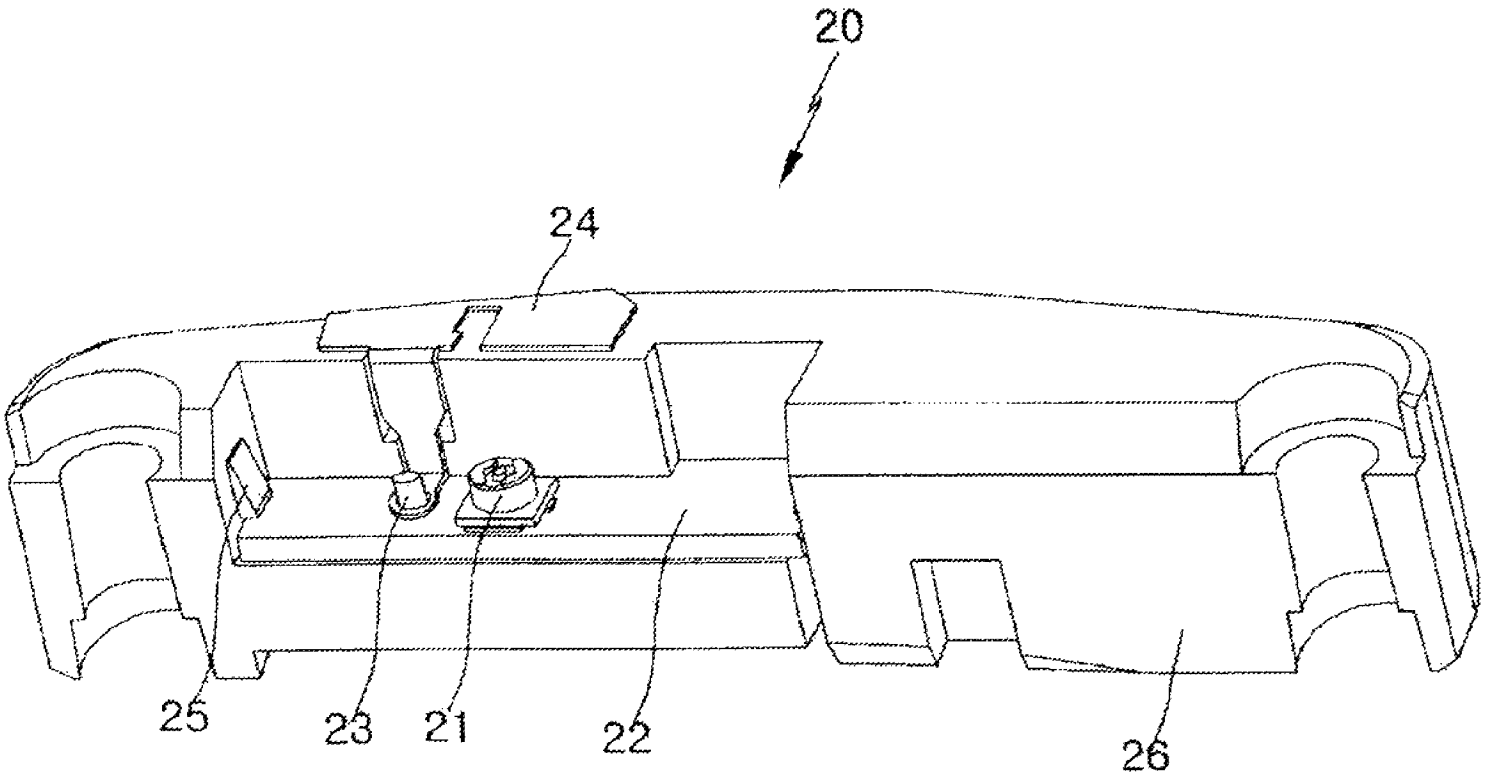
FIG.1B PRIOR ART
FIG. 1B is a view showing another example of a conventional internal antenna having a surface-mounted receptacle.

Preferred embodiments of the present invention are described in detail with reference to the accompanying drawings.

FIG. 2A is a view showing the construction of an internal antenna having a surface-mounted receptacle according to an embodiment of the present invention. The internal antenna includes a printed circuit board 120 configured such that a receptacle 110 is surface-mounted thereon, a radiator 130 electrically connected to the upper surface of the printed circuit board 120, and a frame 140 configured such that the printed circuit board 120 and the radiator 130 are mounted thereto.

As shown in FIG. 2A, the receptacle 110 is a terminal that is used to connect the internal antenna 100 and the main board of a mobile terminal, which are separately disposed in the mobile terminal, to each other using a cable, and is surface-mounted on a receptacle mounting pattern 121, which is formed on the upper surface of the printed circuit board 120.

As shown in FIG. 2B, the receptacle mounting pattern 121, which is configured such that the receptacle 110 is surface-mounted thereon, a first feeding pattern 122, which is configured such that a main signal output from the main board of the mobile terminal is fed thereto, and a first ground pattern 123, which is grounded, are formed on the upper surface of the printed circuit board 120. As shown in FIG. 2C, a second feeding pattern 125, which is configured such that the main signal is fed thereto, and a second ground pattern 126, which is grounded, are formed on the lower surface of printed circuit board 120.

Furthermore, the first feeding pattern 122 and the first ground pattern 123, which are formed on the upper surface of the printed circuit board 120, are electrically connected to the second feeding pattern 125 and the second ground pattern 126, which are formed on the lower surface of the printed circuit board 120, via respective through-holes 124.

As shown in FIG. 2D, the radiator 130 is formed by integrating a radiation part 131, which is used to radiate signals, with a terminal part 133, which is used to make an electrical connection with the printed circuit board 120. The terminal part 133 includes a feeding terminal 134 and a ground terminal 135.

The radiation part 131 is mounted so as to come into close contact with one side surface of the frame 140 in the longitudinal direction thereof. Furthermore, the radiation part 131 has an asymmetrical structure, and is made of a thin metal plate which is bent at multiple locations.

The respective feeding and ground terminals 134 and 135 of the radiator 130 are directly and electrically connected to the first feeding pattern 122 and the first ground pattern 123, which are formed on the upper surface of the printed circuit board 120.

The frame 140 has a structure in which one side surface thereof is bent at multiple locations, and fastening holes are formed in respective ends thereof such that it can be fastened in the mobile terminal.

Furthermore, a single vertically cut surface and a single horizontally cut surface are formed such that a predetermined portion of the frame 140 forms a stair shape. Two grooves 141 and 142 are formed to fasten the respective feeding and ground terminals 134 and 135 of the radiator 130 to the vertically cut surface and the horizontally cut surface.

Accordingly, the printed circuit board 120 is located on the horizontally cut surface of the frame 140, and is locked by hooks 143, which are formed at respective ends of the horizontally cut surface, and thus the printed circuit board 120 is mounted and fastened to the frame 140.

FIGS. 2B and 2C are top and bottom views respectively of the printed circuit board of FIG. 2A. The receptacle mounting pattern 121, the first feeding pattern 122 and the first ground pattern 123 are formed on the upper surface of the printed circuit board 120. The second feeding pattern 125 and the second ground pattern 126 are formed on the lower surface of the printed circuit board 120.

The first feeding pattern 122 and the second feeding pattern 125 are electrically connected to each other via the through-hole 124. Similarly, the first ground pattern 123 and the second ground pattern 126 are electrically connected to each other via the through-holes 124.

The receptacle 110 is brought into contact with a pattern, which is formed in the central portion of the printed circuit board 120 under the receptacle 110, and the circular portion of the receptacle mounting pattern 121. Subsequently, one pin, which is selected from among four pins formed around the receptacle 110 and is connected with the pattern formed in the central portion of the printed circuit board 120 under the receptacle 110, is soldered to the receptacle mounting pattern 121 so that signals can be fed thereto. The remaining three pins are grounded by being soldered directly to the first ground pattern 123.

The above-described main signal, which is received from the main board of the mobile terminal through the cable connected to the receptacle 110, is fed to the first feeding pattern 122, which is connected to the receptacle mounting pattern 121, and at the same time, is fed to the second feeding pattern 125, which is electrically connected via the through-holes 124.

FIG. 2D is a view showing, in detail, the construction of the radiator of FIG. 2A. The radiator 130 is formed by integrating the radiation part 131, which is used to radiate signals, with the terminal part 133, which is used to make an electrical connection with the printed circuit board 120. The terminal part 133 includes the feeding terminal 134 and the ground terminal 135.

In greater detail, the radiator 130 includes the radiation part 131, an extended part 132, which extends vertically from a predetermined portion of one end of the radiation part 131, and the terminal part 133, which is formed by vertically bending one end of the extended part 132. The terminal part 133 includes the feeding terminal 134 and the ground terminal 135, which are spaced apart from each other by a predetermined distance.

Accordingly, the radiation part 131 is mounted so as to come into close contact with one side surface of the frame 140 in the longitudinal direction thereof, the extended part 132 is mounted so as to come into close contact with the upper surface of the frame 140, which is connected to the vertically cut surface formed on the frame 140, and the feeding terminal 134 and the ground terminal 135 are fitted into the respective grooves 141 and 142, which are formed in the frame 140, by which the radiator 130 is fastened to the frame 140.

Each of the feeding terminal 134 and the ground terminal 135, which are fitted into the respective grooves 141 and 142 formed in the frame 140, is provided with a first bent portion 136, which is formed by bending the central portion thereof to a predetermined angle, and a second bent portion 137, which is formed by bending the end thereof to form a V shape.

In the first bent portions 136, which are formed in the respective central portions of the feeding terminal 134 and the ground terminal 135, the respective ends of the feeding terminal 134 and the ground terminal 135 are formed so as to be bent towards the printed circuit board 120. Accordingly, force can be constantly exerted downwards by the first bent portions 136.

Furthermore, the respective lower surfaces of the second bent portions 137 are electrically connected to the first feeding pattern 122 and the first ground pattern 123 by the force that is exerted by the first bent portions 136.

FIG. 2E is a view showing, in detail, the construction of the frame 140 of FIG. 2A. The frame 140 has a structure in which one side surface thereof is bent at multiple locations, and fastening holes are formed in the respective ends thereof such that it can be fastened in the mobile terminal.

Furthermore, a single vertically cut surface and a single horizontally cut surface are formed such that a predetermined portion of the frame 140 forms a stair shape. Two grooves 141 and 142 are formed to fasten the respective feeding and ground terminals 134 and 135 of the radiator 130 to the vertically cut surface and the horizontally cut surface.

In greater detail, the two grooves 141 and 142 are formed in the vertically cut surface from the edge of the frame 140 until the location that the vertically cut surface and horizontally cut surface intersect, and from this point to the edge of the horizontally cut surface continuously. The grooves 141 and 142 are spaced apart from each other by a predetermined distance.

That is, the two grooves 141 and 142 are spaced apart from each other, and each is continuously formed in the vertically cut surface and the horizontally cut surface, which are formed on the frame 140. Furthermore, the hooks 143, which are formed at the respective ends of the horizontally cut surface of the frame 140, fasten the printed circuit board 120 to the frame 140.

In the first embodiment described above, the respective feeding and ground terminals 134 and 135 of the radiator 130, which exert the downward force, are electrically connected to the first feeding pattern 122 and the first ground pattern 123, so that reliable phone call quality can be provided thanks to the stable connection.

FIG. 3A is a view showing the construction of an internal antenna having a surface-mounted receptacle according to another embodiment of the present invention. The internal antenna includes a printed circuit board 220, which is configured such that a receptacle 210 is surface-mounted thereon, a radiator 230, which is electrically connected to the lower surface of the printed circuit board 220, and a frame 240, which is configured such that the printed circuit board 220 and the radiator 230 are mounted thereto.

The electrical connection between the printed circuit board 120 and the radiator 130, shown in the FIG. 2A, is made on the upper surface of the printed circuit board 120, but the electrical connection between the printed circuit board 220 and the radiator 230, shown in FIG. 3A, is made on the lower surface of the printed circuit board 220. Accordingly, the structure of the radiator 230 is changed as shown in FIG. 3A.

Since the structure and characteristics of the other parts, that is, the receptacle 210, the printed circuit board 220 and the frame 240, are the same as those of the receptacle 110, the printed circuit board 120 and the frame 140 in the first embodiment shown in FIG. 2A, the detailed descriptions thereof are omitted. Furthermore, the drawings of the first embodiment are to be referred to for the corresponding parts of the second embodiment.

The radiator 230 is formed by integrating a radiation part 231, which is used to radiate signals, with a terminal part 233, which is used to make an electrical connection with the printed circuit board 220. The terminal part 233 includes a feeding terminal 234 and a ground terminal 235.

The radiation part 231 is mounted so as to come into close contact with one side surface of the frame 240 in the longitudinal direction thereof. Furthermore, the radiation part 231 has an asymmetrical structure, and is made of a thin metal plate that is bent at multiple locations.

The respective feeding and ground terminals 234 and 235 of the radiator 230 are directly and electrically connected to the second feeding pattern 225 and the second ground pattern 226, which are formed on the lower surface of the printed circuit board 220.

FIG. 3B is a view showing, in detail, the construction of the radiator of FIG. 3A. The radiator 230 is formed by integrating the radiation part 231, which is used to radiate signals, with the terminal part 233, which is used to make an electrical connection with the printed circuit board 220.

In greater detail, the radiator 230 includes the radiation part 231, an extended part 232, which extends vertically from a predetermined portion of one end of the radiation part 231, and the terminal part 233, which is formed by vertically bending one end of the extended part 232. The terminal part 233 includes the feeding terminal 234 and the ground terminal 235, which are spaced apart from each other by a predetermined distance.

Accordingly, the radiation part 231 is mounted so as to come into close contact with one side surface of the frame 240 in the longitudinal direction thereof, the extended part 232 is mounted so as to come into close contact with the upper surface of the frame 240, which extends from the vertically cut surface of the frame 240, and the feeding terminal 234 and the ground terminal 235 are fitted into the respective grooves 241 and 242, which are formed in the frame 240, and thus the radiator 230 can be fastened to the frame 240.

The ends of each of the feeding terminal 234 and the ground terminal 235, which are fitted into the respective grooves 241 and 242 formed in the frame 240, is continuously bent two times, and thus first bent portions 236 and second bent portions 237 are formed.

The first bent portions 236, which are formed in the respective ends of the feeding terminal 234 and the ground terminal 235, are bent so as to be in contact with the grooves 241 and 242 formed in the horizontally cut surface of the frame 240. Accordingly, force can be constantly exerted upwards by the first bent portions 236.

Furthermore, in the second bent portions 237, which are formed by bending the respective ends of the feeding terminal 234 and the ground terminal 235 upwards, the respective upper surfaces of the second bent portions 237 are constantly electrically connected to the second feeding pattern 225 and the second ground pattern 226, which are formed on the lower surface of the printed circuit board 220, by the force exerted by the first bent portions 236.

In the second embodiment described above, the respective feeding and ground terminals 234 and 235 of the radiator 230, which exert the upward force, are electrically connected to the second feeding pattern 225 and the second ground pattern 226 formed on the lower surface of the frame 240, so that reliable phone call quality can be provided thanks to the stable connection.

Accordingly, in the above embodiments, the first feeding patterns 122 and 222 and the second feeding patterns 125 and 225 formed on the upper surfaces of the printed circuit boards 120 and 220, are electrically connected with the first ground patterns 123 and 223 and the second ground patterns 126 and 226 formed on the lower surfaces of the printed circuit boards 120 and 220, via the through-holes 124 and 224, which are formed in the respective printed circuit boards 120 and 220. This enables the feeding terminals 134 and 234 and the ground terminals 135 and 235 of the radiators 130 and 230 to perform the same operation even when the upper surfaces of the printed circuit boards 120 and 220, on which the first feeding patterns 122 and 222 and the first ground patterns 123 and 223 are formed, or the lower surfaces of the printed circuit boards 120 and 220, on which the second feeding patterns 125 and 225 and the second ground patterns 126 and 226 are formed, are used.

As described above, in the internal antenna having a surface-mounted receptacle according to the present invention, a receptacle is surface-mounted to the printed circuit board, on which a feeding pattern and the ground pattern are formed, and the terminal part of the radiator, which has a structure that exerts force, is constantly electrically connected to the feeding pattern and the ground pattern. This allows reliable phone call quality to be provided thanks to the stable connection between the printed circuit board and the radiator, and the manufacturing costs can be reduced thanks to the reduction in the number of components. In addition, productivity is improved thanks to the simplified manufacturing process.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An internal antenna having a surface-mounted receptacle, comprising:

a printed circuit board configured such that a receptacle is surface-mounted on an upper surface thereof;

a radiator connected to the printed circuit board; and a frame configured such that the printed circuit board and the radiator are mounted thereto, wherein the printed circuit board is configured to electrically connect the upper surface and a lower surface thereof partially, the frame has a vertically cut surface and a horizontally cut surface formed such that a predetermined portion in the frame forms a stair shape, and has two grooves formed along the vertically cut surface and horizontally cut surface, and the radiator has a feeding terminal and a ground terminal to be fitted into each of the two grooves formed in the frame, and wherein the feeding terminal and ground terminal of the radiator are inserted and fitted into each of the two grooves formed along the vertically cut surface and horizontally cut surface of the frame, the printed circuit board is mounted on and fastened to the horizontally cut surface of the frame to contact the feeding and ground terminals of the radiator to the lower surface of the printed circuit board, and the feeding terminal of the radiator is connected electrically with the receptacle of the printed circuit board.

2. The internal antenna as set forth in claim 1, wherein the printed circuit board is configured such that a receptacle mounting pattern, on which the receptacle is surface-mounted, a first feeding pattern, which is connected to the receptacle pattern and to which a signal is fed, and a first ground pattern, which is grounded, are formed on an upper surface thereof, and such that a second feeding pattern, to which the signal is fed, and a second ground pattern, which is grounded, are formed on a lower surface thereof.

3. The internal antenna as set forth in claim 2, wherein the printed circuit board comprises:

through-holes that are used to electrically connect the first feeding pattern and the second feeding pattern, and to electrically connect the first ground pattern and the second ground pattern.

4. The internal antenna as set forth in claim 1, wherein the frame has a structure in which one side surface thereof is bent at multiple locations, and fastening holes are formed in respective ends thereof to fasten the frame in the mobile terminal.

5. The internal antenna as set forth in claim 4, wherein the radiator comprises:

a radiation part for radiating signals;

an extended part extending vertically from a predetermined portion of one end of the radiation part; and a terminal part formed by vertically bending an end of the extended part, and provided with the feeding terminal and the ground terminal, which are spaced apart from each other by a predetermined distance.

6. The internal antenna as set forth in claim 5, wherein:

the radiation part of the radiator is mounted so as to come into close contact with one side surface of the frame in a longitudinal direction thereof;

the extended part is mounted so as to come into close contact with an upper surface of the frame which is connected to the vertically cut surface that is formed in the frame; and the feeding and ground terminals are fitted into the respective grooves formed in the frame.

7. The internal antenna as set forth in claim 1, wherein each of the feeding and ground terminals of the radiator comprises a first bent portion and a second bent portion, which are formed by continuously bending an end thereof two times.

8. The internal antenna as set forth in claim 7, wherein the first bent portions, which are formed at the respective ends of the feeding terminal and the ground terminal, are bent so as to be in contact with the grooves formed in the horizontally cut surface of the frame, thus exerting force upwards.

9. The internal antenna as set forth in claim 7, wherein the second bent portions formed at the respective ends of the feeding terminal and the ground terminal, are bent upwards from the first bent portions so that respective upper surfaces of the second bent portions are constantly electrically connected to the second feeding pattern and the second ground pattern formed on the lower surface of the printed circuit board, by force attributable to the first bent portions.

* * * * *